US007562423B2

(12) United States Patent
Pryd-Kakuk

(10) Patent No.: US 7,562,423 B2
(45) Date of Patent: Jul. 21, 2009

(54) MEMORY CONTAINER AND METHOD OF MEMORIALIZING A LIFE

(76) Inventor: Lexann Pryd-Kakuk, 3615 Southview Ct., St. Cloud, MN (US) 56301

( * ) Notice: Subject to any disclaimer, the term of this patent is extended or adjusted under 35 U.S.C. 154(b) by 0 days.

(21) Appl. No.: 11/879,058

(22) Filed: Jul. 16, 2007

(65) Prior Publication Data

US 2008/0010792 A1 Jan. 17, 2008

Related U.S. Application Data

(60) Provisional application No. 60/831,338, filed on Jul. 17, 2006.

(51) Int. Cl.
*A61G 17/00* (2006.01)

(52) U.S. Cl. ..... 27/1; 40/124.5; 40/722

(58) Field of Classification Search ..... 27/1, 27/35; D99/5; 40/722, 725, 124.5; 211/85.27; 52/134, 136
See application file for complete search history.

(56) References Cited

U.S. PATENT DOCUMENTS 3,928,928 A 12/1975 Kalust
4,001,959 A 1/1977 Grendahl
4,169,970 A 10/1979 Opiela et al.
4,199,848 A * 4/1980 Kohnert ..... 27/1
4,648,162 A 3/1987 Daino
5,088,167 A 2/1992 Rahe
5,625,933 A 5/1997 Neuberger et al.
5,704,103 A 1/1998 Crowley et al.
5,729,921 A * 3/1998 Rojas ..... 40/124.5
5,896,632 A 4/1999 Sturino
5,950,287 A * 9/1999 Cacciatore et al. ..... 27/1
5,950,288 A * 9/1999 Bach Lahor ..... 27/1
6,023,822 A 2/2000 Luebke
6,044,532 A * 4/2000 Bowling et al. ..... 27/1
D432,285 S 10/2000 Baldwin et al.
D433,209 S 10/2000 Baldwin et al.
6,347,439 B1 * 2/2002 Bach Lahor ..... 27/1
6,414,663 B1 7/2002 Manross, Jr.
6,421,890 B1 * 7/2002 Biggar ..... 27/1
6,526,636 B2 * 3/2003 Bernhardt ..... 27/1
6,681,534 B2 1/2004 David et al.
6,735,831 B1 * 5/2004 Greiwe et al. ..... 27/1
6,800,167 B1 10/2004 Frazer
6,944,921 B1 * 9/2005 Gersten ..... 27/1
7,036,195 B2 * 5/2006 Glass ..... 27/1
7,082,653 B1 * 8/2006 Sueppel ..... 27/1
7,117,570 B1 * 10/2006 Borgerding ..... 27/1
7,191,499 B2 * 3/2007 Davis et al. ..... 27/1
D540,505 S 4/2007 Perreault
7,308,740 B2 * 12/2007 Roberts ..... 27/1
7,308,741 B1 12/2007 Rydberg et al.
2001/0049867 A1 * 12/2001 Tseng ..... 27/1
2005/0125973 A1 * 6/2005 Hankel et al. ..... 27/1
2005/0144821 A1 * 7/2005 Griesemer et al. ..... 40/546
2006/0207075 A1 * 9/2006 Davis ..... 27/1
2007/0084027 A1 * 4/2007 Walczak ..... 27/1

OTHER PUBLICATIONS

Compilation of Photographs; Undated.

* cited by examiner

*Primary Examiner*—William L. Miller

(57) ABSTRACT

A personalizable memory container including a container portion having a cavity therein, a sealable capsule selectively disposable in the cavity, and mementos selectively presentable on reconfigurable spaces on the container portion. The mementos can conceal the capsule when the capsule is disposed in the cavity and when the mementos are selectively presented on the reconfigurable spaces.

19 Claims, 7 Drawing Sheets

MEMORY CONTAINER AND METHOD OF MEMORIALIZING A LIFE

RELATED APPLICATION

The present application claims the benefit of U.S. Provisional Application No. 60/831,338, filed Jul. 17, 2006, which is incorporated herein in its entirety by reference.

TECHNICAL FIELD

The present invention relates generally to containers. More particularly, the present invention relates to a container including one or more receptacles for storing cremains, mementos, and/or keepsakes.

BACKGROUND OF THE INVENTION

There is a growing trend towards cremation of deceased humans and pets over full body burial. It has been estimated that over thirty-five percent of deaths will result in cremation by the year 2010. There is an established practice of retaining cremains in containers, such as urns, in addition to "scattering" or burying.

Existing urns, however, do not enable the creation of a configurable personalized memorial for the storage and presentation of cremains, mementos, and/or keepsakes. As an example, existing urns do not illustrate how someone lived their life or who they were. Existing urns also do not meet the individual needs of various surviving friends and family members. There is therefore need for an improved memory container.

BRIEF SUMMARY

The personalizable memory containers according to embodiments of the present invention overcome the deficiencies of existing urns by providing the ability to illustrate how someone lived their life and who they were. The personalizable memory containers can meet the individual needs of various surviving friends and family members. The number of ways that a person or pet can be memorialized can be as diverse as the number of people or pets.

In an embodiment, a personalizable memory container includes a container portion having a cavity therein, a sealable capsule selectively disposable in the cavity, and one or more mementos selectively presentable on one or more reconfigurable spaces on the container portion.

In another embodiment, an urn includes a container portion having a cavity therein, a sealable cremains receptacle selectively disposable in the cavity, and one or more mementos selectively presentable on one or more reconfigurable spaces on the container portion.

In yet another embodiment, a method of providing an urn for memorializing a life includes providing a container having a cavity therein, a sealable cremains receptacle selectively disposable in the cavity, and one or more reconfigurable spaces for selectively presenting one or more mementos with the container. The method can further include providing instructions to: place cremains into the receptacle, dispose the receptacle in the cavity, and selectively present one or more mementos with the spaces.

BRIEF DESCRIPTION OF THE DRAWINGS

FIG. 110*a* is a close-up view of lights included on the memory container of FIG. 10.

Figure 1:
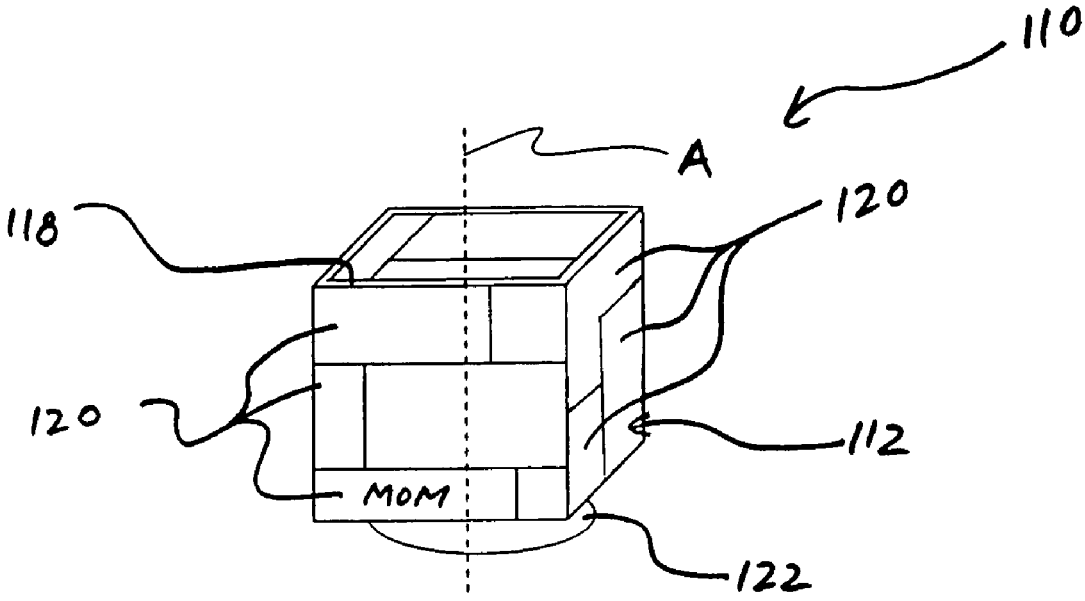
FIG. 1 is a perspective view of a memory container according to a first embodiment.

While the embodiments of the present invention are amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the present invention.

DETAILED DESCRIPTION OF THE DRAWINGS

The memory container according to the various embodiments enables the creation of a personalized memorial of a life, such as a human or pet's life. For example, the memory container enables the creation of a "story" behind a person's life at a glance or a reflection of other important "life" events, such as birthdays, anniversaries, weddings, or birth of a new child. The memory container enables someone to create an in-home memorial, whether or not it holds cremated remains or not. People often do not live by a cemetery where the remains are buried or next to the place where the remains are scattered. With the variety of disposition locations, retirement communities out of state, and the transient culture in which we live, proximity to a final resting place can be distant. An in-home memorial that is flexible, portable, and readily available, survivors can have an opportunity to pay tribute at any time that they desire.

The memory container further enables meeting evolving needs experienced because of changes to furnishings, decor, or as more information about the deceased becomes available. Furthermore, the ability for the family to perform the personalization themselves quickly and easily and enables a highly personalized memorial to be present at a memorial service to help bring closure and understanding of the deceased to the attendees of the service.

Referring to FIGS. 1-4, a memory container 110 of a first embodiment broadly includes a container portion 112 and one (FIG. 4) or more (FIG. 7) capsules 114 to hold cremains and/or mementos therein. Capsules 114 can be disposed in one or more respective chambers or cavities 116 included in container portion 112. Container portion 112 can also include slots, channels, or other structures 118 thereon or therein for holding photos, scrap booking pages, and other mementos 120. Memory container 110 can also include a base 122 that enables turning or rotating of container portion 112 to enable viewing of the photos, scrap booking pages, and other mementos 120 on all sides of container portion 112.

Figure 5:
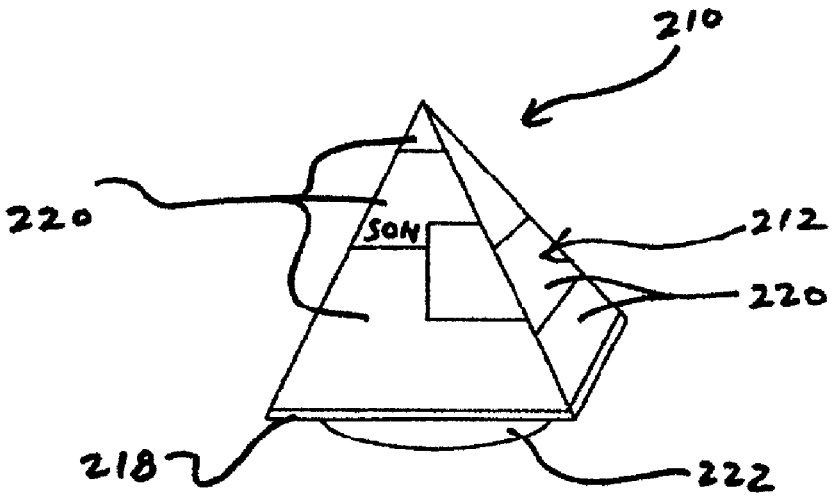
FIG. 5 is a perspective view of a memory container according to a second embodiment.

Referring to FIGS. 1 and 5, in embodiments, container portion 112 can be cube shaped (FIG. 1) or obelisk shaped (FIG. 5). Other shapes can be used, such as spheres, octahedrons, tetrahedrons, and other three-dimensional geometric shapes, and combinations thereof.

Obelisk-shaped memory container 210 of a second embodiment broadly includes a container portion 212 and one capsules (not depicted) to hold cremains and/or mementos therein. Container portion 212 can also include slots, channels, or other structures 218 thereon or therein for holding photos, scrap booking pages, and other mementos 220. Memory container 210 can also include a base 222 that enables turning or rotating of container portion 212 to enable viewing of the photos, scrap booking pages, and other mementos 220 on all sides of container portion 212.

Container portion 112 of embodiments can be constructed of materials such as glass or acrylic (trade name PLEXIGLAS®). Container portion 112 can be tempered to inhibit breaking or chipping of container portion 112. Container portion 112 can be constructed of other materials, such as wood, stone, plastic, or polylactic acid (PLA) resin. In addition, container portion 112 can be painted, coated or covered with material such as fabric, rhinestone, veneer, vinyl, or BELBIEN®, to add to the aesthetic appeal of container portion 112. Container portion 112 also enables someone to configure their own memory container in preparation for their inevitable passing.

Figure 2:
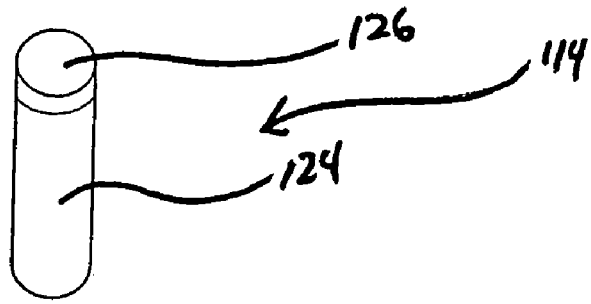
FIG. 2 is a perspective view of a capsule for use with a memory container.

Referring to FIG. 2, capsule 114 can comprise a body 124 and a cap 126. Body 124 and cap 126 can each comprise threading to retain cap 126 on body 124 and retain the contents of capsule 114. Alternatively, cap 126 can frictionally fit on body 124. In other embodiments, the capsule 114 comprises body 124, cap 126, and a sealing gasket 127, which forms a tight seal between cap 126 and body 124 of capsule 114. Other mechanisms can be used to retain the cap 126 on the body 124 and retain the contents of the capsule 114. While depicted as being cylindrical, the capsule 114 can be other shapes, such as spheres, octahedrons, tetrahedrons, and other 3D geometric shapes and combinations thereof.

Figure 3:
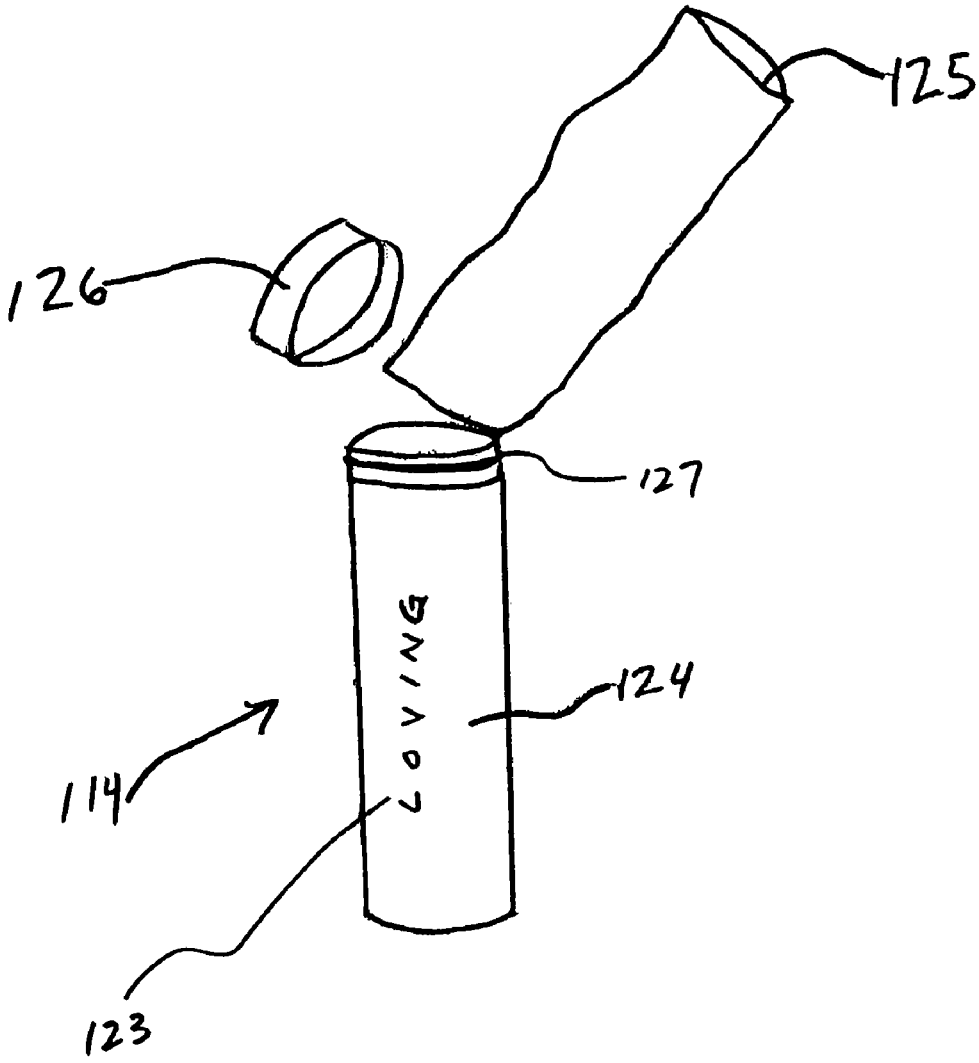
FIG. 3 is a perspective view depicting a bag and the capsule of FIG. 2.

Capsule 114 can be constructed of metals such as bronze, brass, copper, aluminum, stainless steel or other metal and combinations thereof suitable for preserving cremains and/or other mementos therein. Further, capsule 114 can be constructed of stone such as granite, marble, soapstone, malachite or other stone and combinations thereof suitable preserving cremains and/or other mementos therein. Referring to FIG. 3, the cremains can also be enclosed in a plastic bag or enclosure 125 before being put in capsule 114. Bag or enclosure 125 can be constructed of other materials such as polylactic acid resin. Capsule 114 can be constructed of plastic, wood, or other materials and combinations thereof depending upon the desired type of item to be placed in capsule 114.

Referring to FIG. 3, in an embodiment, capsule 114 can comprise words, phrases, or quotes 123 thereon. For example, capsule 114 can comprise one or more words, such as "loving," "family," "work," "adventure," or other words that might be used to describe a person's life. Capsule 114 can also comprise personal information such as name date of birth, or other information about a person or his or her life.

Figure 4:
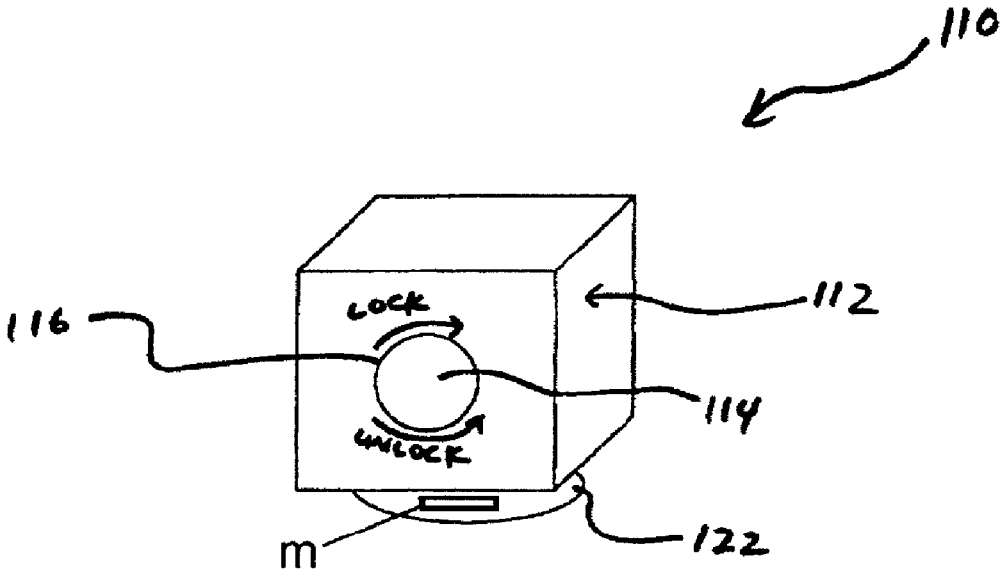
FIG. 4 is a schematic view depicting the capsule of FIG. 2 being rotated/locked in a chamber included on a container portion of the memory container of FIG. 1.

Referring to FIG. 4, capsule 114 can comprise a locking mechanism. The locking mechanism can be positional on the base of capsule 114 and can be "keyless" so that there is no key to lose. For example, capsule 114 and chamber 116 can comprise male and female threading, respectively, or vice versa. In other keyless embodiments, capsule 114 integrates pins that extend into chamber 116 upon insertion of capsule 114 thus securing it in container portion 112. In other embodiments, the locking mechanism can comprise a key. In other embodiments the locking mechanism can comprise a combination lock. Other types of locking mechanisms can be used to retain capsule 114 within chamber 116 in container portion 112.

Referring again to FIG. 1, slots or channels 118 on the sides and top of container portion 112 can accommodate photos, paper stock-like construction paper, thin album pages, and other scrap booking type materials. In addition, wider slots or channels 118 on the sides and top of container portion 112 can be included to accommodate bigger and thicker mementos. The material of container portion 112 on either side of the slots or channels 118 can be clear (such as glass or acrylic (PLEXIGLAS®) to enable viewing of the photos, scrap booking pages, and other mementos 120 when in slots or channels 118. The material of container portion 112 can also include some tinting or coloring for decorative purposes, while still enabling viewing of photos or memorabilia, thus adding artistic appeal.

Referring to FIGS. 4 and 5, memory containers 110, 210 of the first and second embodiments can also include covers 128, 228. Covers 128, 228 can be constructed of materials such as glass or acrylic (trade name PLEXIGLAS®). Covers 128, 228 can be tempered to inhibit breaking or chipping of covers 128, 228. Covers 128, 228 can be constructed of other materials, such as wood, stone or plastic or polylactic acid resin. Covers 128, 228 can enable individuals to easily alter the look of memory containers 110, 210, mixing and matching it with the decor of various settings, or using the memory containers 110, 210 as a functional piece, such as a pedestal for art or other objects. In addition, covers 128, 228 can be painted, coated or covered with a material such as fabric, rhinestone, veneer, vinyl or BELBIEN®, to add to the aesthetic appeal of covers 128, 228.

Figure 6:
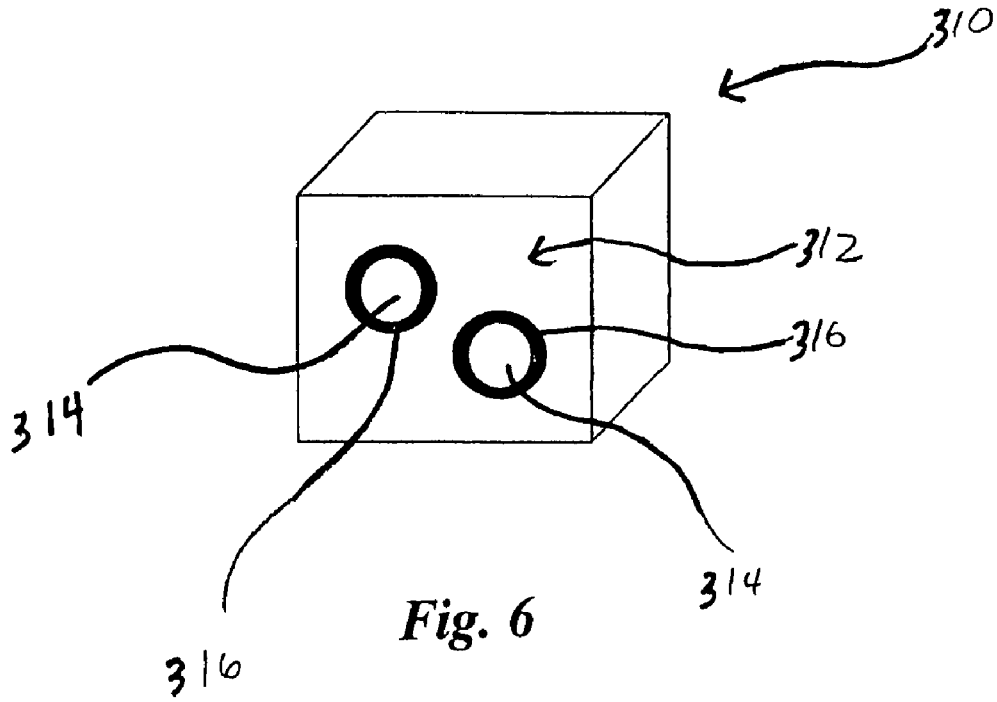
FIG. 6 is a perspective view of a memory container according to a third embodiment.

Referring to FIG. 6, in a third embodiment, a memory container 310 can include a container portion 312 and two capsules 314 disposed in two cavities 316.

Figure 7:
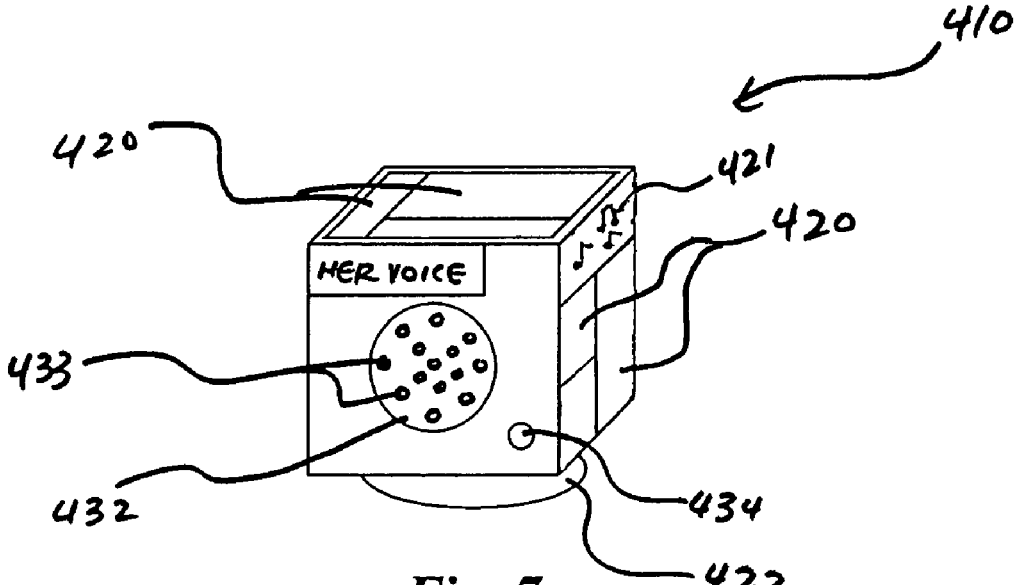
FIG. 7 is a perspective view of a memory container according to a fourth embodiment.
Figure 8:
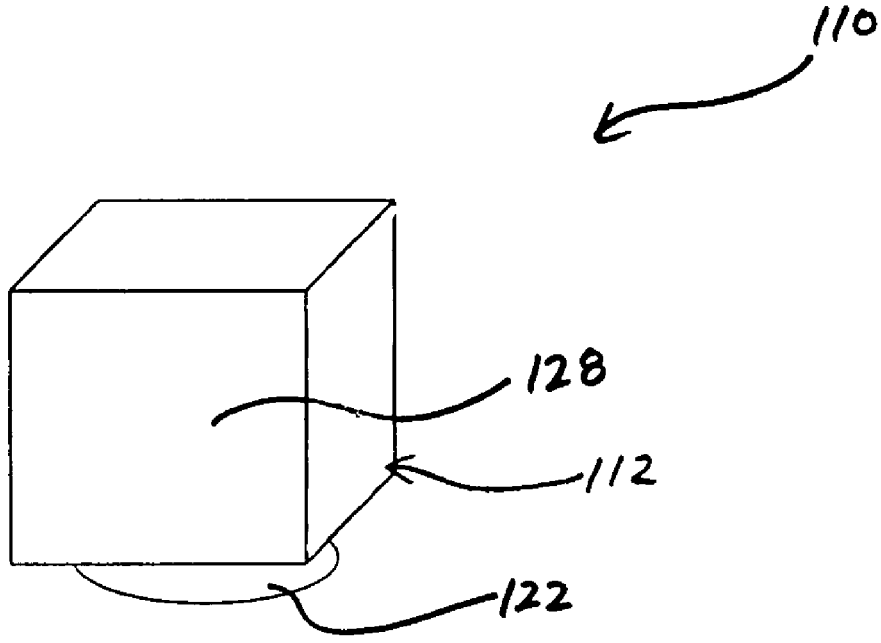
FIG. 8 is a perspective view of the memory container of FIG. 1 having a cover disposed thereon.
Figure 9:
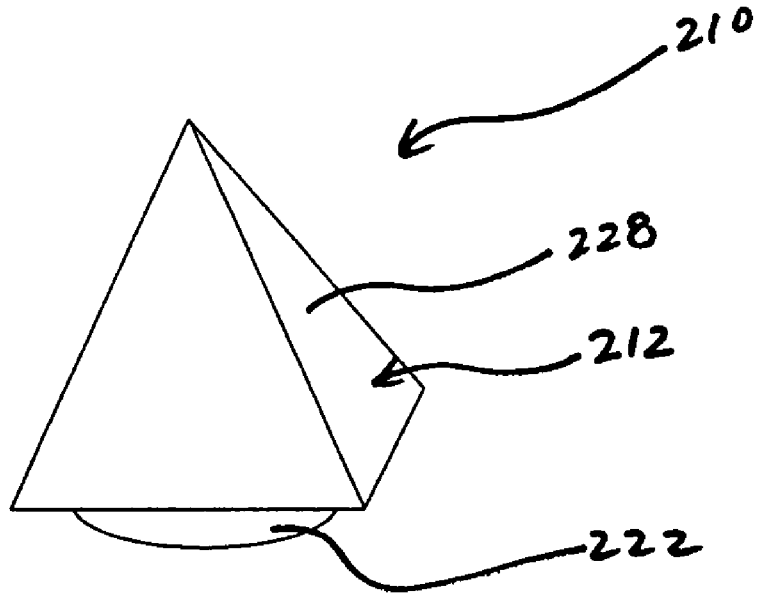
FIG. 9 is a perspective view of the memory container of FIG. 5 having a cover disposed thereon.

Referring to FIG. 7, in a fourth embodiment, slots or channels 418 included in a memory container 410 can be wide enough to accommodate mementos 420 or a speaker 432 to enable the playing of songs, melodies, pre-recorded phrases or combinations thereof. In other embodiments speaker 432 is activated by a small button 434 for cycling through recorded phrases. As examples, memory container 410 can display notes 421 of a decedent's favorite song or melody and include an embedded speaker that will play a decedent's favorite song or melody. According to an embodiment, memory container 410 can have an embedded speaker 432 that will emit a short phrase. Container portion 412 can have several small holes 433 on an exterior side face to enable speaker 432 to function efficiently. Memory container 410 according to the fourth embodiment can also include a base 422 upon which container portion 412 can rotate.

Figure 10:
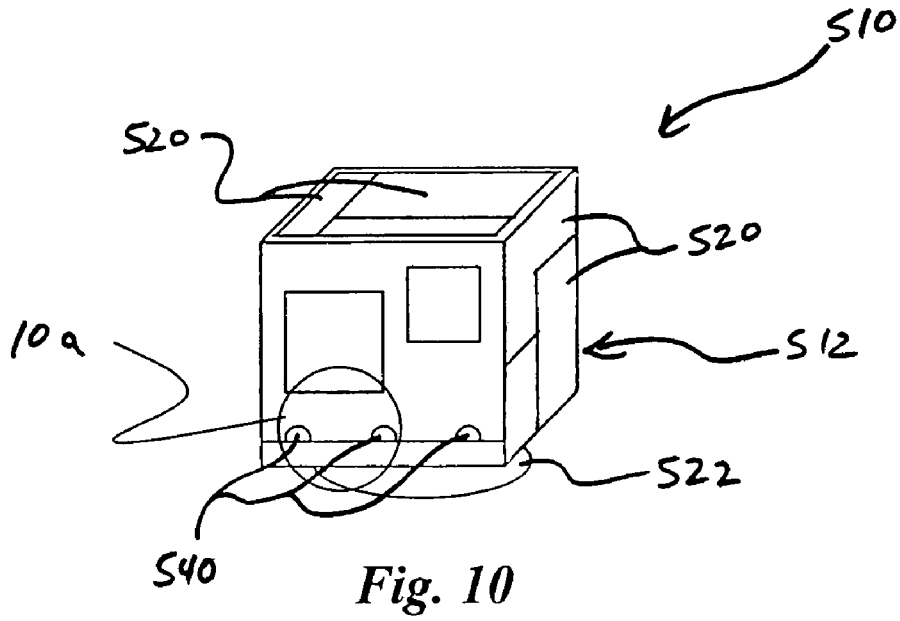
FIG. 10 is a perspective view of a memory container according to a fifth embodiment.
Figure 10A:
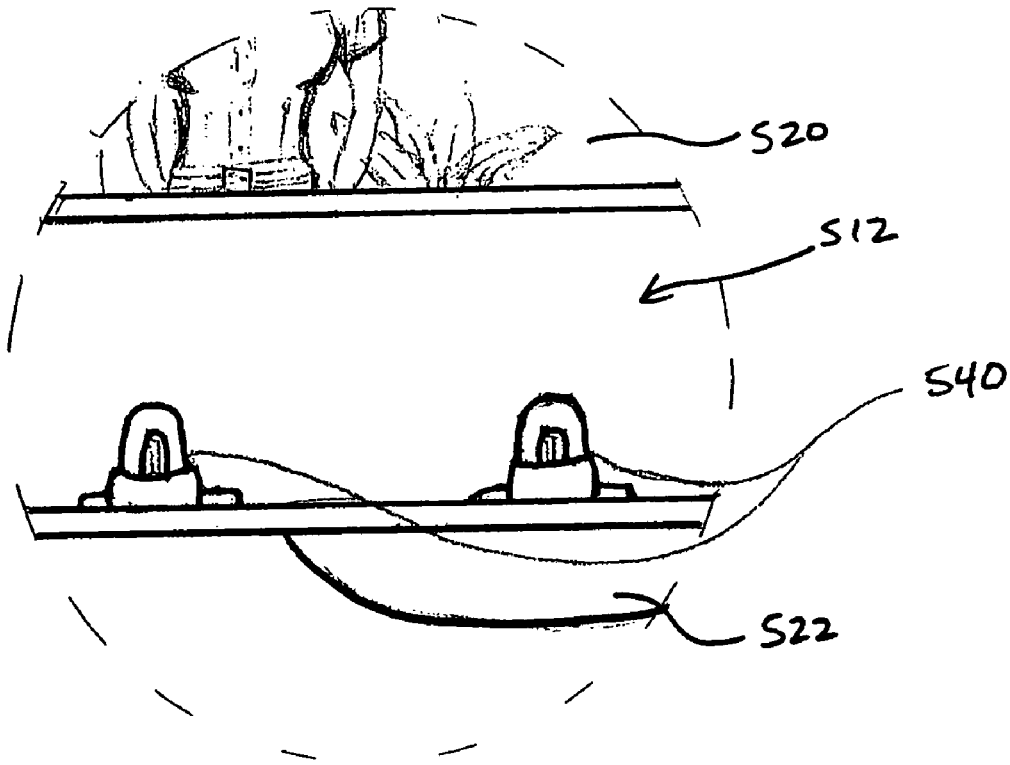

Referring to FIGS. 10 and 10*a*, in a fifth embodiment, slots or channels 518 presented with a container portion 512 of a container 510 can be configured to receive lights 540 (such as Light Emitting Diode (LED)), in addition to or in lieu of mementos 520, to enable further personalization of container portion 512. Lights 540 can be powered by, for example, battery, wired electricity, a solar panel, or the like.

Figure 11:
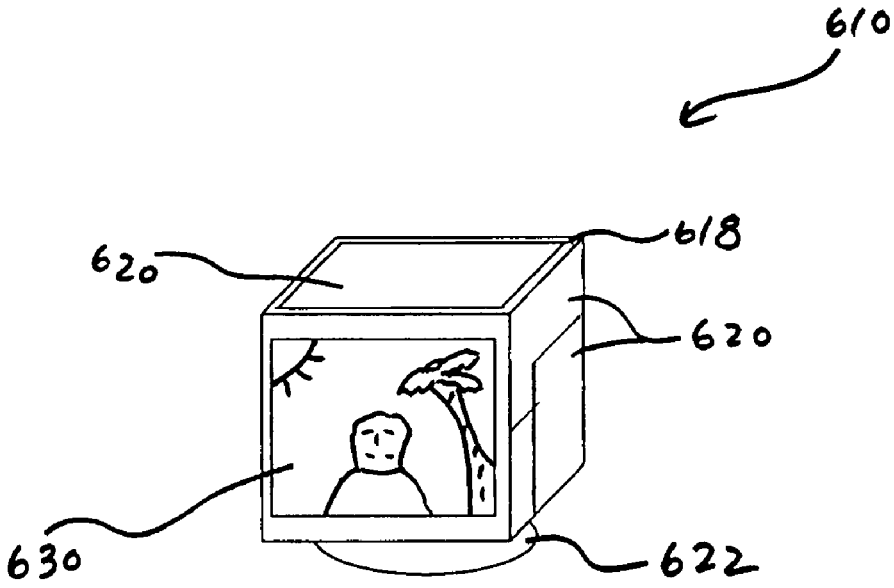
FIG. 11 is a perspective view of a memory container according to a sixth embodiment.

Referring to FIG. 11, in a sixth embodiment, slots or channels 618 presented with a container portion 612 of a container 610 can be configured to accommodate one or more electronic displays 630 (such as Liquid Crystal (LCD) or Organic Light Emitting Display (OLED)), in addition to or in lieu of mementos 620, to enable further personalization of container portion 612 by enabling display of digital photography and/or digital video content. Displays 630 can be powered by, for example, battery, wired electricity, a solar panel, or the like.

As described herein, memory container 110 according to various embodiments can also include a base 122. Base 122 can be constructed of materials such as wood or metal. Base 122 can be constructed of other materials such as plastic or polylactic acid resin. In one embodiment, base 122 enables rotation of the memory capsule about at least one axis. In other embodiments base 122 includes an electronic motor M which will automatically rotate the memory cube about at least one axis of rotation "A."

The various parts of memory container 110 (e.g., container portion 112, capsule 114, base 122) can be constructed of material so as to be as lightweight as possible to enable moving memory container 110 from location to location, room-to-room, and/or be placed on a high mantle or shelf. A lighter material of the various parts of memory container 110 (e.g., container portion 112, capsule 114, base 122) can be painted, coated or covered with material such as fabric, rhinestone, veneer, vinyl or BELBIEN®, to provide the appearance of marble, wood, or other material without compromising its light weight.

Memory container 110 can be available in multiple sizes and can be used for a single human's cremains, two or more human's cremains, or one or more small, medium or large pet's cremains. Memory container 110 can be available in any size needed to effectively store cremains.

In an embodiment, a memory container system can comprise a plurality of smaller "keepsake" size containers, such that a plurality of persons can have a memory container. For example, for a deceased man, his wife can have a "husband" keepsake container, his brother or sister can have a "brother" keepsake container, and each of his children can have a "father" keepsake container. Each of these keepsake containers can include the features of the embodiments of the memory container described herein.

A deceased's cremains can be divided and retained within one of multiple memory containers 110. For example, after the cremation of a man's body, his cremains can be divided among a "dad" container, a "brother" container, a "friend" container, and so on. In addition, some of the cremains can be divided between a memory container 110 and jewelry, such as a necklace, or other personal item having a chamber for retaining cremains therein.

In other embodiments, container 110 and capsule 114 can be used for keeping a keepsake or memento therein. In this embodiment, memory container 110 can function as a memory capsule. For example, if a person does not want to use capsule 114 for cremains (for example, if they scatter), she can still put keepsakes and/or mementos in capsule 114 so the keepsakes and the mementos can be private and inside container portion 110 of the product and the photographs shown on the outside.

Moreover, container 110 can be used to tell the "story" behind the life at a glance or reflect other important "life" events, for example, birthdays, anniversaries, weddings, graduations, promotions, or birth of a new child. For example, a "graduation" cube can be used to store photos and programs of the graduation ceremony. A tassel, program from the commencement ceremony, school ring, or other memento can be placed into capsule 114 for safekeeping thereof. Other examples might include: (1) high school prom—a garter or menu from the restaurant where the couple ate dinner can be stored and (2) the birth of a child—a receiving blanket and baby shoes can be stored. Any item, or portion thereof, related to the event or milestone, or unrelated—as the owner of the container 10 deems memorable—as long as it fits within capsule 114, can be stored.

In an embodiment, memory container displays two coinciding timelines, one of important "world" events, for example wars, inventions, elections, discoveries and aligns the life of a decedent thereupon displaying important "life" events, for example, birthdays, graduations, anniversaries, weddings or other important living achievements.

Moreover, capsule 114 can be used to enable the viewing of the keepsakes or mementos placed within. In one embodiment capsule 114 is constructed of a clear material that magnifies the contents placed therein (such as glass or acrylic (PLEXIGLAS®) thus displaying the mementos and protecting them from the elements. An aspect of memory container 110 is to provide the ability to highly personalize memory container 110 through the eyes of the owner, whatever he or she deems it to be.

The embodiments above are intended to be illustrative and not limiting. Additional embodiments are within the claims. In addition, although the present invention has been described with reference to particular embodiments, those skilled in the art will appreciate that changes can be made in form and detail without departing from the spirit and scope. Any incorporation by reference of documents above is limited such that no subject matter is incorporated that is contrary to the explicit disclosure herein.

What is claimed is:

1. An urn for storing cremains of a deceased, said urn comprising:

a polylactic acid container portion having a cavity therein and one or more reconfigurable spaces thereon, the polylactic acid being an optically transparent material;

a sealable cremains capsule selectively disposed in said cavity and viewable therein, said capsule for storing said cremains of said deceased; and one or more mementos selectively presented on said one or more reconfigurable spaces presented on said container portion, wherein said one or more mementos conceal said capsule.

2. The container of claim 1, further comprising a cover over said container portion concealing said one or more reconfigurable spaces.

3. The container of claim 1, wherein said one or more mementos are selected from the group consisting of: a photograph, a scrap-booking page, and combinations thereof.

4. The container of claim 1, further comprising a second cavity in said container portion and a second capsule selectively disposable in said second cavity.

5. The container of claim 4, wherein said second capsule is configured for storing a keepsake therein.

6. The container of claim 1, wherein said sealable cremains capsule comprises a body and a cap operably coupleable with said body to form a sealed interior.

7. The container of claim 1, further comprising a base coupled with said container portion, said container portion being rotatable on said base.

8. The container of claim 1, further comprising a locking mechanism for selectively locking said sealable cremains capsule relative to said container portion.

9. An urn for storing cremains of a deceased, said urn comprising:

a polylactic acid container portion having a cavity therein and a plurality of reconfigurable spaces encompassing a plurality of exposed surfaces of said container portion, said polylactic acid being an optically transparent material;

a sealable cremains receptacle selectively disposed in said cavity and viewable therein, said receptacle for storing said cremains of said deceased; and one or more mementos selectively presented within one or more of said plurality of reconfigurable spaces presented on said container portion, wherein said one or more mementos conceal said receptacle.

10. The urn of claim 9, wherein said one or more mementos are selected from the group consisting of: a photograph, a scrap-booking page, and combinations thereof.

11. The urn of claim 9, wherein said cremains receptacle comprises a body, a cap operably coupleable with said body, and a sealing member presented between said body and said cap to form a sealed interior.

12. The urn of claim 9, further comprising a base coupled with said container portion, said container portion being rotatable on said base.

13. The urn of claim 12,further comprising an electronic motor which rotates said container portion upon said base.

14. The urn of claim 9, further comprising a cover over said container portion concealing said one or more reconfigurable spaces.

15. A method of providing an urn for storing cremains of a deceased and for memorializing a life, comprising:

providing a polylactic acid container having a cavity therein and one or more reconfigurable spaces on said container for selectively presenting one or more mementos therewith, wherein said polylactic acid is an optically transparent material, a sealable cremains receptacle selectively disposable in said cavity and viewable therein, wherein said receptacle is adapted to store said cremains of said deceased, and said one or more mementos selectively presentable on said one or more reconfigurable spaces to conceal said receptacle;

providing instructions to:

place said cremains into said cremains receptacle;

dispose said cremains receptacle in said cavity in said container; and selectively present said one or more mementos on said one or more reconfigurable spaces to conceal said receptacle.

16. The method of claim 15, further comprising:

providing a second cavity in said container and a second receptacle selectively disposable in said second cavity; and providing further instructions to;

place a keepsake into said second receptacle; and dispose said second receptacle in said second cavity.

17. The method of claim 15, further comprising providing further instructions to select said one or more mementos from the group consisting of: photographs, scrap-booking pages, and combinations thereof.

18. The method of claim 15, further comprising the steps of:

providing a cover; and covering said container with said cover to thereby conceal said mementos.

19. The method of claim 15, further comprising the steps of:

providing a base;

coupling said base with said container; and rotating said container about said base to display all of said one or more mementos from a single viewing location.

* * * * *